United States Patent [19]

Ishikawa et al.

[11] Patent Number: 4,778,746

[45] Date of Patent: Oct. 18, 1988

[54] METHOD OF PROCESSING A SILVER HALIDE PHOTOGRAPHIC MATERIAL

[75] Inventors: Masao Ishikawa; Shigeharu Koboshi; Satoru Kuse, all of Hino, Japan

[73] Assignee: Konishiroku Photo Industry Co., Ltd., Tokyo, Japan

[21] Appl. No.: 97,293

[22] Filed: Sep. 14, 1987

Related U.S. Application Data

[63] Continuation of Ser. No. 835,475, Mar. 3, 1986, abandoned, which is a continuation-in-part of Ser. No. 731,127, May 6, 1985, abandoned.

[30] Foreign Application Priority Data

May 15, 1984 [JP] Japan ..... 59-95613

[51] Int. Cl.[4] ..... G03C 7/26; G03C 7/30; G03C 7/34; G03C 7/16

[52] U.S. Cl. ..... 430/372; 430/384; 430/385; 430/551; 430/552

[58] Field of Search ..... 430/372, 384, 385, 551, 430/552

[56] References Cited

U.S. PATENT DOCUMENTS 2,870,015 1/1959 Allen et al. ..... 430/614
4,329,851 12/1980 Aoki et al. ..... 430/377
4,336,324 6/1982 Koboshi et al. ..... 430/372
4,537,856 8/1985 Kurematsu et al. ..... 430/372

*Primary Examiner*—Mukund J. Shah
*Attorney, Agent, or Firm*—Jordan B. Bierman

[57] ABSTRACT

A method of processing a silver halide color photographic material including color developing said silver halide color photographic material containing a cyan coupler represented by the following Formula, then, treating said material with a processing solution having a fixing capability, and then subjecting said material to stabilizing treatment Formula wherein R' represents hydrogen, $R_1$ represents a straight or branched alkyl group having two to four carbon atoms, X represents hydrogen or a group capable of splitting off with a coupling reaction, and $R_2$ represents a ballast group.

12 Claims, No Drawings

METHOD OF PROCESSING A SILVER HALIDE PHOTOGRAPHIC MATERIAL

This application is a continuation of Ser. No. 835,475, filed Mar. 3, 1986, now abandoned, which is a continuation in part of Ser. No. 731,127, filed May 6, 1985, now abandoned.

This invention relates to a method of processing a silver halide color photographic material (hereinafter referred to as a photographic material) and more particularly to a method of processing a photographic material capable of forming a dye image excellent in preservation stability extending over a long period of time after processing upon omitting a washing step.

BACKGROUND OF THE INVENTION

In general, a photographic material is processed, after it was exposed imagewise, in the processing steps such as a color developing, bleaching, fixing, stabilizing, bleaching-fixing, and washing steps. In the washing step which follows after the step carried out with a processing solution having a fixing capability, a compound such as a thiosulfate forming a water-soluble complex salt upon reacting with a silver halide and other water-soluble silver complex salts and, in addition, such a preserving agent as a sulfite, metabisulfite and the like are brought together with a photographic material into the washing step. In the case of a small quantity of washing water, it is well-known that an image preservability will be affected thereby. The real situation of solving such weak points as mentioned above is that the above-mentioned salts are washed off from a photographic material by making use of a great quantity of running water in a washing step after processing the photographic material with a processing solution having a fixing capability. In recent years, however, for the economical reasons such as the shortage of water resources, rises in water rates, heat and light expenses, and the like, and for the reasons of environmental pollution, a reduction in washing water quantity and a countermeasure against pollution have been desired to take into processing steps.

Heretofore, these countermeasures including, for example, such a method of making water counter-flow by arranging washing tanks to be multistage system as described in West German Pat. No. 2,920,222; S. R. Goldwasser, 'Water Flow Rate in Immersion—Washing of Motion Picture Film', SMPTE, Vol. 64, pp. 248–253, May 1955; and the like.

There is a well-known processing method in which a prewashing step is provided immediately after a fixing bath so as to reduce pollution components coming into a washing step together with a photographic material and to reduce the washing water quantity.

The above-mentioned technique are not used in such a processing method in which washing water is not used at all. In recent years therefore, the expenses for washing operation have been increased due to the exhaustion of water resources and the increase in crude oil cost. These problems of the increase in washing expenses and the like have been becoming more serious.

On the other hand, there are the other processing methods in which a stabilizing process is carried out immediately after completing photographic processes without carrying out any washing step. For example, there is a well-known silver stabilization process such as described in U.S. Pat. No. 3,335,004 and others, in which a thiocyanate is used. In this process, however, there are the defects that a formed image dye is apt to become a leuco dye because the stabilizing bath contains a number of sulfites, and that a color photographic image is therefore deteriorated by the serious influences thereof.

As for the methods of omitting a washing step or extremely reducing a quantity of washing water, there are well-known methods such as a multistage countercurrent type stabilization process described in for example, Japanese Patent O.P.I. Publication No. 8543/1982, and a processing technique using a stabilizing liquid containing a bismuth complex salt as described in Japanese Patent O.P.I. Publication No. 134636/1983. Any of these is a technique for reducing the replenishing quantity of the stabilizing liquid and improving environmental pollutions though, it was found that such techniques were by no means satifactory in the long-time preservability of a photographic image and in particular that cyan dyes were easily deteriorated under the conditions of a high temperature and humidity. In addition, it was also found that the above-mentioned troubles were caused by a varied replenishing quantity of stabilizing liquid or by a processing liquid concentrated by a seasonal variation or a change in quantity of material processed.

SUMMARY OF THE INVENTION

Objects of the Invention

It is an object of the invention to provide a method of processing a photographic material, in which any washing water is not used at all and costs of energy and burdens on environmental pollutions can be reduced.

Another object of the invention is to provide a method of processing a photographic material, in which a color photographic image and particularly a cyan dye image can be produced so as to be stable in a long-term preservation even if no washing water is used at all.

Constituents of the Invention

The method of the invention is a method of processing an imagewise exposed photographic material containing a cyan coupler having the following formula, comprising color-developing the photographic material, then treating with a processing solution having a fixing capability and thereafter processing in a stabilizing treatment step not including a substantial washing step.

Formula

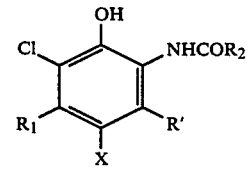

wherein one of $R_1$ and R' represents hydrogen and the other thereof represents a straight or branched alkyl group having at least 2 to 12 carbon atoms; X represents hydrogen or a group capable of splitting off with a coupling reaction; and $R_2$ represents a ballast group.

The effects of the invention can become remarkable by a further preferred embodiment in which a stabilizing solution to be used in said stabilizing treatment step contains a chelating agent of not less than six in the constant of chelating stability to iron.

DETAILED DESCRIPTION OF THE INVENTION

The invention will now be described in more detail.

In a stabilizing process from which a washing step is substantially omitted, a number of the ingredients of a fixing solution or a bleaching-fixing solution or a soluble silver complex salt and the decomposed materials thereof are brought into a stabilizing solution, as described above, and chiefly thereof a photographic image is deteriorated in long-term stability, in the case of such a continuous process from a process carried out with the fixing solution or the bleaching-fixing solution directly to a stabilizing process.

Therefore, in order to keep the long-term stability of a color-image, there uses a process in which any of the ingredients of a fixing solution or a bleaching-fixing solution, or a soluble silver complex salt and the decomposed materials thereof does not remain at all, and in general there uses a process in which tanks are increased in number or a stabilizing solution is replenished in large quantities in the case of carrying out a satisfactory washing or a stabilizing process without any washing step. However, these processes cannot be preferred processes because these processes disagree with the aforementioned objects of reducing costs and improving enviromental pollutions. It has been considered that there is an antinomic relation between the stabilization treatments of a color image and the stabilization processes for reducing costs and improving environmental pollutions, and many studies thereof have therefore been made so far. However, any satisfactory results have not ever been obtained. To solve the problems in the antinomic characteristics, the objects of the invention can be achieved by making use of a photographic material containing a coupler of the invention represented by the Formula in combination with such a process as mentioned above. In particular, the long-term stability of a cyan dye can remarkably be improved under the conditions of a high temperature and a high humidity. In a combination of a cyan dye forming coupler of the invention with a stabilization process, the long-term stability of a dye image can further be improved under the conditions of a high temperature and a high humidity by containing in a stabilizing solution with a chelating agent of not less than 6.0 in the constant of chelating stability to iron.

The term, 'a stabilizing step' means, in the invention, that a stabilizing process is carried out by a single or multistage counter-current system immediately after processing with a processing solution having a fixing capability. Wherein it is also allowed to include the processing steps other than a general washing step, such as those of rinse, auxiliary washing, well-known washing acceleration bath and the like.

The stabilizing solution is replenished in amounts which are 0.1 to 30, preferably 0.5 to 10, times the amounts of stabilizing solution carried over from previous baths per unit area of silver halide photographic material.

In the stabilizing steps of the invention, a preferred method of bringing a stabilizing solution into contact with a photographic material is to dip the photographic material into the stabilizing bath in a similar way of dipping a general processing solution, and it is allowed to coat onto the emulsion surface of a photographic material, both surfaces of a transport leader or a transport belt with the use of a sponge, synthetic fiber and like. It is also allowed to blow upon by a spray gun.

A stabilizing bath used in a dipping method will mainly be described now as follows:

In the invention, it is preferred that a stabilizing solution is to contain a chelating agent of not less than 6.0 in the constant of chelating stability to iron ions.

A constant of chelating stability mentioned herein means a constant generally known by L. G. Sillen A. E. Martell, 'Stability Constants of Metal-ion Complexes', The Chemical Society, London (1964); S. Chaberek A. E. Martell, 'Organic Sequestering Agents', Wiley (1959).

In the invention, such chelating agents of not less than 6.0 in the constant of chelating stability to iron ions include, for example, an organic carboxylic acid chelating agent, an organic phosphoric acid chelating agent, an inorganic phosphoric acid chelating agent, a polyhydroxy compound, and the like. The above-mentioned iron ion means ferric ion, ($Fe^{3+}$).

In the invention, as for the typical compounds to be used for such chelating agents of not less than 6.0 in the constant of chelating stability to ferric ions, the following compounds may be given as the examples thereof: Namely, ethylenediamine orthohydroxyphenyl acetic acid, diaminopropane tetraacetic acid, nitrilotriacetic acid, hydroxyethylethylenediamine triacetic acid, hydroxyethyl glycine, ethylenediamine diacetic acid, ethylenediamine dipropionic acid, iminodiacetic acid, diethylene triamine pentaacetic acid, dihydroxyethylimino diacetic acid, diaminopropanoltetraacetic acid, transcyclohexanediamine tetraacetic acid, glycoletherdiaminetetraacetic acid, ethylenediaminetetrakismethylene phosphonic acid, nitrolotrimethylene phosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate, and sodium hexametaphosphate; and those particularly preferable to use include diethylenetriamine pentaacetic acid, nitrolotriacetic acid, 1-hydroxyethylidene-1,1-diphosphonic acid and the salts thereof.

The amount of the above-mentioned chelting agents to be used in the invention is 0.01 g to 50 g per liter of a stabilizing solution, and more preferably within the range of from 0.05 g to 20 g, from which an excellent result may be obtained.

Compounds which are to be desirably added in a stabilizing solution of the invention include, for example, an antimold agent, a water-soluble metal salt and an ammonia compound. It is particularly desired that a stabilizing solution of the invention contains an antimold agent to improve the long-term preservability of a color dye prepared of the couplers of the invention.

The antimold agents described above include, for example, compounds of a type such as isothiazoline, benzimidazole, benzoisothiazoline, thiabenzazole, phenol, mercapto, organic halogen-substituted compounds, benzoic acid and the derivatives thereof. Among these antimold agents, a compound of isothiazoline, benzoisothiazoline, thiabenzazole, phenol and benzoic acid may be used, and more particularly isothiazoline, benzoisothiazoline and thiabenzazole may preferably be used.

Concrete examples of the compounds will be given below:

(1) 2-methyl-4-isothiazoline-3-one
(2) 5-chloro-2-methyl-4-isothiazoline-3-one
(3) 2-methyl-5-phenyl-4-isothiazoline-3-one
(4) 4-bromo-5-chloro-2-methyl-4-isothiazoline-3-one
(5) 2-hydroxymethyl-4-isothiazoline-3-one
(6) 2-(2-ethoxyethyl)-4-isothiazoline-3-one
(7) 2-(N-methyl-carbamoyl)-4-isothiazoline-3-one
(8) 5-bromomethyl-2-(N-dichlorophenyl-carbamoyl)-4-isothiazoline-3-one
(9) 5-chloro-2-(2-phenylethyl)-4-isothiazoline-3-one
(10) 4-methyl-2-(3,4-dichlorophenyl)-4-isothiazoline-3-one
(11) 1,2-benzoisothiazoline-3-one
(12) 2-(2-bromoethyl)-1,2-benzoisothiazoline-3-one
(13) 2-methyl-1,2-benzoisothiazoline-3-one
(14) 2-ethyl-5-nitro-1,2-benzoisothiazoline-3-one
(15) 2-benzyl-1,2-benzoisothiazoline-3-one
(16) 5-chloro-1,2-benzoisothiazoline-3-one These compounds are disclosed in U.S. Pat. Nos. 2,767,172, 2,767,173, 2,767,174 and 2,870,015, British Pat. No. 848,130, and French Pat. No. 1,555,416 in which the synthesis methods and the examples applicable to other fields are explained. Some of these compounds are on the market and can be obtained under the tradename Top-suicide 300, Top-suicide 600 (mfd. by Parm Chem Asia), Fine-suicide J-700 (mfd. by Tokyo Fine Chemical Co.) and Proxel GXL (mfd. by I.C.I. Co.).

The above compounds may be used in an amount of from 0.01 to 50 g per liter of a stabilizing solution and more preferable results may be obtained by adding those in an amount of from 0.05 to 20 g.

The metallic salts suitable for the invention are those of Ba, Ca, Ce, Co, In, La, Mn, Ni, Pb, Sn, Zn, Ti, Zr, Mg, Al and Sr. They may be supplied as inorganic salts such as halides, hydroxides, sulphates, carbonates, phosphates and acetates or as water-soluble chelating agents. They are used in an amount of from $1\times10^{-4}$ to $1\times10^{-1}$ mol, per liter of a stabilizing solution preferably from $4\times10^{-4}$ to $2\times10^{-2}$ mol and more preferably from $8\times10^{-4}$ to $1\times10^{-2}$ mol.

Various additives other than the compounds described above may arbitrarily be added to the stabilizing bath of the invention for the purpose of improving and increasing the processing effects. The examples thereof are optical brightening agents, organic sulphur compounds, onium salts; water-drop-mark preventing agents such as quaternary salts, polyethylene oxide derivatives and cyclohexane derivatives; pH buffer agents such as boric acid, citric acid, phosphoric acid, acetic acid, sodium hydroxide, sodium acetate and potassium citrate; organic solvents such as methanol, ethanol and dimethylsulfoxide; dispersing agents such as ethylene glycol and polyethylene glycol, color tone controlling agents and the like.

In the stabilizing process of the invention, if a multi-tank counter-current method is employed to supply a stabilizing solution, it is preferable that the stabilizing solution is supplied into a rear-bath and overflown from a fore-bath. The compounds described above may be added in any method, for example, by adding them into a stabilizing tank as a concentrated solution, by supplying them into a stabilizing solution with a supply-solution which is prepared by adding the above compounds and other additives into a stabilizing solution which is to be supplied into a stabilizing tank or by adding them into a fore-bath in the stabilizing process to make them contain in the photographic material and as a result they are made present in the stabilizing bath.

The pH value of the processing solution of the stabilizing bath in the invention is preferably in the range of from 4 to 8. If a pH value is not more than 4, there may occur troubles that silver sulfide may easily be produced and a filter may be colgged. If a pH value is not less than 8, water incrustation and microorganisms will occur. Therefore, the stabilizing bath of the invention is used at a pH value of from 4 to 8.

The pH value may be adjusted by pH buffer agents.

The stabilizing process is carried out at a temperature of from 15° C. to 60° C. and preferably from 20° C. to 45° C. And the shorter processing time is better for the purpose of rapid processing. Generally the processing time is in the range of from 20 sec. to 10 min. and most preferably from 1 min. to 5 min. It is preferable that the processing time is shorter in the fore-bath and longer in the rear-bath.

Washing process is not needed before and after the stabilizing process of the invention, however, a processing tank may be provided, which is used for a rinse in a small amount of water, for a surface washing with a sponge or the like, for an image stabilization and for an adjustment of the surface property of a photographic material. For an image stabilization and surface property adjustment of the photographic material, there are activators such as formalin, and the derivatives thereof, cyclohexane derivatives, polyethylene oxide compounds and quaternary salts may be used.

The expression, 'processing solution having a fixing capability' used herein means a solution containing a soluble complex-forming agent which solubilizes a silver halide into a complex salt, and an ordinary type fixing solution, a bleaching-fixing solution, a monobath developing-fixing solution and a monobath development-bleaching-fixing solution are included. The effects of the invention can be displayed more remarkably when processing particularly with the bleaching-fixing solution.

Typical examples of soluble complex-forming agents include thiosulfates such as potassium thiosulfate, sodium thiosulfate and ammonium thiosulfate; thiocyanates such as potassium thiocyanate, sodium thiocyanate and ammonium thiocyanate; thiourea, thioether, bromides of high concentration and iodides. It is particularly preferable that the processing solution of the invention contains a thiosulfate for aging stability of dye-images, chemical stability and the formation of silver halides and soluble complex.

The processing method of the invention may be applied to color paper, reversal color paper, color positive film, color negative film, color reversal film and color X-ray film.

Cyan dye forming couplers of the invention are represented by the Formula described before.

A straight or branched chain alkyl group having 2 to 12 carbon atoms represented by $R_1$ or R' in the formula [I] is, for example, a methyl, ethyl, propyl or butyl group. R' is preferably hydrogen.

A ballast group represented by $R_2$ in the Formula is an organic group having such a size and a configuration as to provide a coupler molecule with bulk sufficient enough not to substantially diffuse a coupler to neighboring layers from a layer in which the coupler is incorporated. Typical examples of the ballast groups are an alkyl or aryl group having 8 to 32 carbon atoms and more preferably 13 to 28 carbon atoms. These alkyl or aryl groups may have a substituent and as the substituents for an aryl group, for example, an alkyl, aryl, alkoxy, aryloxy, carboxy, acyl, ester, hydroxy, cyano, nitro, carbamoyl, carbamide, alkylthio, arylthio, sulfonyl, sulfonamide, sulfamoyl group and a halogen are included. As the substituents for an alkyl group, these are given the same substituents as above except for an alkyl group.

The ballast group represented by the following formula is preferable.

$$-\underset{\underset{R_3}{|}}{CH}-O-Ar$$

wherein, $R_3$ represents an alkyl group having 1 to 12 carbon atoms, Ar represents an aryl group such as a phenyl group. The aryl group may have a substituent such as an alkyl, hydroxy and alkylsulfonamide group, and a branched alkyl group such as t-butyl group is most preferable. The group defined as X in the Formula which is to split off by the coupling reaction, as is well-known in the art, determines an equivalent value and influences coupling reactivity. Examples thereof include a halogen such ad chlorine and fluorine, an aryloxy group, a substituted or unsubstituted alkoxy, aryloxy, sulfonamide, arylthio, heteroylthio, heteroylthio, heteroyloxy, sulfonyloxy and carbamoyloxy group. Further, concrete examples thereof are described in Japanese Patent O.P.I. Publication Nos. 10135/1975, 120334/1975, 130441/1975, 48237/1978, 146828/1976, 14736/1979, 37425/1972, 123341/1975 and 95346/1983, Japanese Patent Examined Publication No. 36894/1973, U.S. Pat. Nos. 3,476,563, 3,737,316 and 3,227,551.

Examplified compounds of the invention will be described as follows. The exemplified compounds are represented by the Formula in which $R_1$, X, $R_2$ and R' are given specifically as follows.

(Exemplified Compound)

| Coupler No. | $R_1$ | X | $R_2$ | R' |
|---|---|---|---|---|
| (1) | $-C_2H_5$ | $-Cl$ | 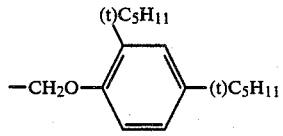 | $-H$ |
| (2) | $-C_2H_5$ | 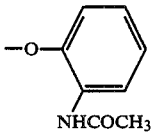 | 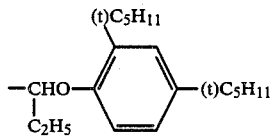 | $-H$ |
| (3) | 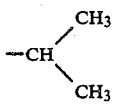 | $-Cl$ | 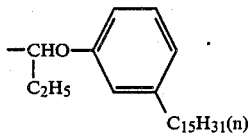 | $-H$ |
| (4) | $-C_2H_5$ | $-Cl$ | 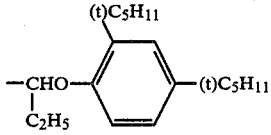 | $-H$ |
| (5) | $-C_2H_5$ | $-H$ | 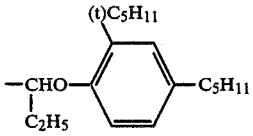 | $-H$ |
| (6) | $-C_2H_5$ | $-Cl$ | 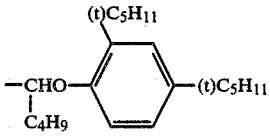 | $-H$ |
| (7) | $-C_2H_5$ | $-Cl$ | 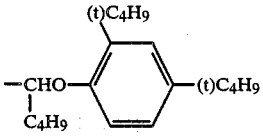 | $-H$ |

-continued
| Coupler No. | $R_1$ | X | (Exemplified Compound) $R_2$ | R' |
|---|---|---|---|---|
| (8) | $-C_2H_5$ | $-H$ | 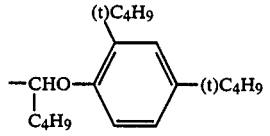 | $-H$ |
| (9) | $-C_4H_9$ | $-F$ | 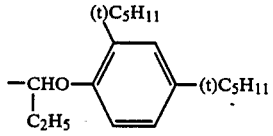 | $-H$ |
| (10) | $-C_2H_5$ | $-F$ | 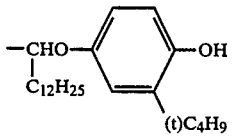 | $-H$ |
| (11) | $-C_2H_5$ | $-Cl$ | 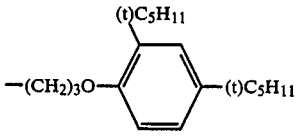 | $-H$ |
| (12) | $-C_2H_5$ | $-F$ | 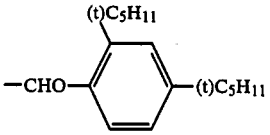 | $-H$ |
| (13) | $-C_4H_9$ | $-Cl$ | 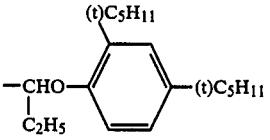 | $-H$ |
| (14) | $-C_2H_5$ | $-Cl$ | 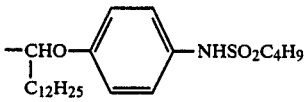 | $-H$ |
| (15) | $-C_2H_5$ | $-Cl$ | 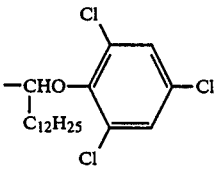 | $-H$ |
| (16) | 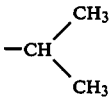 | $-Cl$ | $-C_{18}H_{37}$ | $-H$ |
| (17) | $-C_2H_5$ | $-F$ | 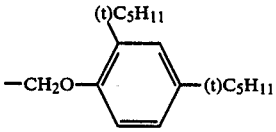 | $-H$ |
| (18) | $-C_2H_5$ | 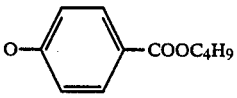 | 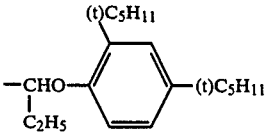 | $-H$ |

-continued

| Coupler No. | $R_1$ | X | (Exemplified Compound) $R_2$ | R' |
|---|---|---|---|---|
| (19) | $-C_2H_5$ | $-Cl$ | 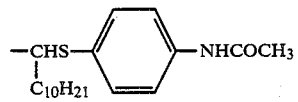 | $-H$ |
| (20) | $-C_3H_7$ | $-Cl$ | 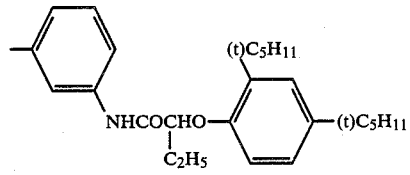 | $-H$ |
| (21) | $-C_3H_7$ | $-Cl$ | 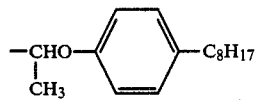 | $-H$ |
| (22) | $-C_2H_4NHCOCH_3$ | $-Cl$ | 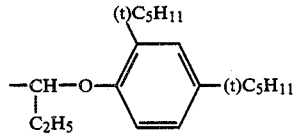 | $-H$ |
| (23) | $-C_3H_6OCH_3$ | $-Cl$ | 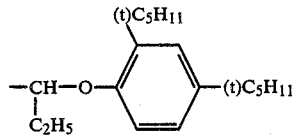 | $-H$ |
| (24) | $-H$ | $-Cl$ | 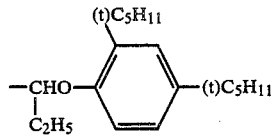 | $-C_2H_5$ |
| (25) | $-H$ | $-Cl$ | 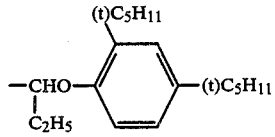 | $-C_3H_7$ |
| (26) | $-H$ | $-Cl$ | 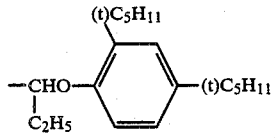 | $-C_{15}H_{31}$ |

Following is a synthesis method of exemplified compounds of the invention and other exemplified compounds may be synthesized in the similar manner.

Synthesis example of exemplified compound (1)

<(1)-a> Synthesis of 2-nitro-4,6-dichloro-5-ethylphenol 2-nitro-5-ethylphenol of 33 g, 0.6 g of iodine and 1.5 g of ferric chloride were dissolved in 150 ml of glacial acetic acid. Into this, 75 ml of sulfuryl chloride were dropped for three hours at 40° C. The precipitates produced during the drop were reacted to dissolve by heating-reflux after finishing sulfurylchloride drop. Heating-reflux took about two hours. The reaction solution was poured into water and the crystals thus formed were recrystalized and refined. (1)-a was confirmed by nuclear magnetic resonance spectrum and elemental analysis.

<(1)-b> Synthesis of 2-amino-4,6-dichloro-5-ethylphenol

Compound <(1)-a> of 21.2 g was dissolved in 300 ml of alcohol, and to this was added Raney nickel in a catalytic amount and hydrogen was supplied through this at atmospheric pressure until hydrogen was not absorbed. After the reaction, Raney nickel was eliminated and alcohol was distilled off at reduced pressure. The residue of <(1)-b> was subjected to acylation without refining.

<(1)-c> Synthesis of 2[(2,4-di-tert-acylphenoxy)acetamide]-4,6-dichloro-5-ethylphenol Crude amino compound of 18.5 g obtained at <(1)-b> was dissolved into a mixture solution of 500 ml of glacial acetic acid and 16.7 g of sodium acetate. To this was dropped at room temperature for 30 min. an acetic acid solution in which 28.0 g of 2,4-di-tert-amino-phenoxy acetic acid chloride was dissolved in 50 ml of acetic acid. After the drop, stirred for 30 min. and then the reaction solution was poured into glacial water. Thus formed precipitates was filtrated out to be dried, and recrystallized twice with acetonitrile and thus intended compound was obtained. The compound was confirmed by elemental analysis and nuclear magnetic resonance spectrum.

| | $C_{21}H_{35}NO_3Cl_2$ | | | |
|---|---|---|---|---|
| | C | H | N | Cl |
| calculated value (%) | 65.00 | 7.34 | 2.92 | 14.76 |
| measured value (%) | 64.91 | 7.36 | 2.99 | 14.50 |

Cyan couplers represented by the Formula of the invention may be used in combination with conventionally known cyan couplers so far as it does not depart from the objects of the invention.

As for non-color providing couplers which may be used in combination with the couplers of the invention, those described in British Pat. Nos. 861,138, 914,145 and 1,109,963, Japanese Patent Examined Publication No. 14033/1970, U.S. Pat. No. 3,580,722 and Mitteilungen aus den Forschningslaboratorien der AGFA Leverkusen Vol. 4, 1964, pp. 352–367 may be used.

Cyan couplers represented by the Formula of the invention may be contained in the silver halide emulsion layer, generally in an amount of from 0.05 to 2 mol per mol of a silver halide and preferably in an amount of from 0.1 to 1 mol.

Silver halide emulsions suitable for the invention include those using any of such silver halides as silver chloride, silver bromde, silver iodide, silver chlorobromide, silver iodochloride, silver iodobromide and silver chloroiodobromide. As for protective colloids for these silver halides, natural substances such as gelatin and various synthesized substances may be used. The silver halide emulsions may contain photographic additives such as stabilizers, sensitizers, hardeners, sensitizing dyes and surfactants.

Materials usable for a support include polyethylene coated paper, triacetate film, polyethylene terephthalate film, white polyethylene terephthalate film and the like.

Aromatic primary amine color developing agent used in the invention for the color developer include conventionally known agents widely used in various color photographic processes. These developing agents include derivatives of aminophenol and p-phenylenediamine. These compounds are used in the form of salt such as a hydrochloride and a sulphate because they are more stable in the form of salt than in the free form. These compounds are used in an amount of approximately 0.1 g to 30 g per liter of color developer and preferably about 1 g to 15 g.

Aminophenol developing agents include, for example, o-aminophenol, p-aminophenol, 5-amino-2-oxytoluene, 2-amino-3-oxytoluene and 2-oxy-3-amino-1,4-dimethylbenzene.

Particularly useful aromatic primary amine color developing agents are N,N'-dialkyl-p-phenylenediamine compounds in which an alkyl or phenyl group may be replaced by an arbitrary substituent. Among them, the examples of particularly useful compounds include N,N'-diethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline and 4-amino-N-(2-methoxyethyl)-N-ethyl-3-methylaniline-p-toluenesulfonate.

To the color developers used for the process of the invention, besides the aromatic primary amine color developing agents, various ingredients usually added to color developers may arbitrarily be added. Examples of such ingredients include, for example, alkali agents such as sodium hydroxide, sodium carbonate and potassium carbonate, alkali metal sulfites, alkali metal bisulfites, alkali metal thiocyanates, alkali metal halides, benzyl alcohol, water softening agents and thickening agents. The pH value of the color developer is usually not less than 7 and most commonly, approximately from 10 to 13.

In the invention, after the color development process, the processing by the processing solution having fixng capability is carried out, however, if a processing solution having a fixing capability is a fixing solution, bleaching process is to be done before fixing. As for a bleaching solution used for the bleaching process or bleaching agents used for the bleaching-fixing solution, metal complex salts of an organic acid may be used. The metal complex salts have the function that a metallic silver produced through a development is oxidized to change into a silver halide and simultaneously the uncolor-developed areas of color forming agents are developed. The structure thereof is that an organic acid such as aminopolycarboxylic acid, oxalic acid or citric acid is coordinated with an ion of a metal such as iron, cobalt or copper. The organic acids used most preferably for forming metal complex salts of these organic acids include polycarboxylic acids or aminopolycarboxylic acids. These polycarboxylic acids or aminopolycarboxylic acids may also be alkali metal salts, ammonium salts or water soluble amine salts.

The concrete examples thereof are given below:

(1) ethylenediaminetetraacetic acid
(2) diethylenetriaminepentaacetic acid
(3) ethylenediamine-N-(β-oxyethyl)-N,N',N'-triacetic acid
(4) propylenediaminetetraacetic acid
(5) nitrilotriacetic acid
(6) cyclohexanediaminetetraacetic acid
(7) iminodiacetic acid
(8) dihydroxyethylglycinecitric acid (or tartaric acid)
(9) ethyletherdiaminetetraacetic acid
(10) glycoletherdiaminetetraacetic acid
(11) ethylenediaminetetrapropionic acid
(12) phenylenediaminetetraacetic acid
(13) ethylenediaminetetraacetic acid disodium salt
(14) ethylenediaminetetraacetic acid tetratrimethylammonium salt
(15) ethylenediaminetetraacetic acid tetrasodium salt
(16) diethylenetriaminepentaacetic acid pentasodium salt
(17) ethylenediamine-N-(β-oxyethyl)-N,N',N'-triacetic acid sodium salt
(18) propylenediaminetetraacetic acid sodium salt
(19) nitrilotriacetic acid sodium salt

(20) cyclohexanediaminetetraacetic acid sodium salt

The bleaching solution used for the invention may contain such a metal complex salt of an organic acid as described above to serve as a bleaching agent as well as various additives. As for additives, it is preferable to contain a metal salt rehalogenating agent such as alkali halides or ammonium halides including, for example, potassium bromide, sodium bromide, sodium chloride and ammonium bromide, and chelating agents. The pH buffer agents such as borates, oxalates, acetates, carbonates and phosphates, and additives which are conventionally known to be added to a bleaching solution, for example, alkylamines, polyethyleneoxides and the like may suitably be added.

Further, a fixing solution and a bleaching-fixing solution may contain singly or in combination pH buffer agents comprising sulfites such as ammonium sulfite, potassium sulfite, ammonium bisulfite, potassium bisulfite, sodium bisulfite, potassium metabisulfite an sodium metabisulfite, and various salts such as boric acid, borax, sodium hydroxide, potassium hydroxide, sodium carbonate, potassium carbonate, sodium bicarbonate, potassium bicarbonate, acetic acid, sodium acetate and ammonium hydroxide.

When the processing of the invention is carried out by replenishing a bleach-fix bath with a bleach-fix replenishing agent, a thiosulfate, thiocyanate, sulfite or the like may be contained in the bleach-fix bath, or the processing bath may be replenished with the bleach-fix replenisher containing the salts thereof.

In the invention, in order to increase the activity of a bleaching-fixing solution, air or oxygen may, if desired, be blown into the bleach-fix bath and the storage tank of the bleach-fix replenisher, or suitable oxidizing agents such as hydrogen peroxide, bromates and persulfates may be added.

In the processing of the invention, silver may be recovered by a conventionally known method from a processing solution containing soluble silver complex salt, namely, stabilizing solution, a fixing solution and a bleaching-fixing solution. The useful methods include the electrolysis method disclosed in French Pat. No. 2,299,667, the precipitation method in Japanese Patent O.P.I. Publication No. 73037/1979 and West German Pat. No. 2,331,220, the ion exchange method in Japanese Patent O.P.I. Publication No. 17114/1976 and West German Pat. No. 2,548,237 and the metal substitution method in British Pat. No. 1,353,805.

[EXAMPLE]

The invention will be described more detailedly with reference to the following examples.

EXAMPLE 1

Any one of an exemplified cyan coupler of the invention shown in Table 1 and comparative couplers (1) to (3) shown below in the amount of 6.0 g, 25 g of high boiling-point solvent dibutylphthalate (hereinafter abbreviated to DBP), 18 g of ethyl acetate and if necessary a suitable amount of dimethylformamide were mixed. The mixing solution was heated at 60° C. to be dissolved. This was mixed with 100 ml of a 5% aqueous gelatin solution containing 10 ml of a 5% aqueous solution of Alkanol B (alkylnaphthalenesulfonate, mfd. by DuPont). Emulsification-dispersion of the resulting mixture was made by an ultrasonic homogenizer and thus the dispersion solution was obtained.

Next, the dispersion solution was added to a silver chlorobromide emulsion containing 10 mol% silver chloride to the ratio that a cyan coupler shown in Table 1 is 10 mol% per mol of silver and then, as a hardener, 12 mg of 1,2-bis(vinylsulfonyl)ethane per gram of gelatin was further added to the emulsion. The resulting emulsion was coated on to a polyethylene coated paper support in a coated silver amount of 7 mg per 100 $cm^2$. Thus, color paper samples No. 1 to 12 were obtained.

The samples were exposed through a wedge in a usual manner and were then processed in the following manner.

| | processing temperature | processing time |
|---|---|---|
| (1) color development | 38° C. | 3 min. 30 sec. |
| (2) bleach-fix | 38° C. | 1 min. 30 sec. |
| (3) stabilizing treatment | 25~30° C. | 3 min. |
| (4) drying | 75~80° C. | approx. 2 min. |

| Composition of the processing solution | |
|---|---|
| (color development tank solution) | |
| benzyl alcohol | 15 ml |
| ethylene glycol | 15 ml |
| potassium sulfite | 2.0 g |
| potassium bromide | 0.7 g |
| sodium chloride | 0.2 g |
| potassium carbonate | 30.0 g |
| hydroxylaminesulfate | 3.0 g |
| polyphosphoric acid (TPPS) | 2.5 g |
| 3-methyl-4-amino-N—ethyl-N—(β-methanesulfonamidoethyl)-anilinesulfate | 5.5 g |
| optical brightening agent (4,4'-diaminostilbenedisulfonic acid derivative) | 1.0 g |
| potassium hydroxide | 2.0 g |
| add water to make 1 liter | |
| adjust pH at 10.20 | |
| (bleach-fix tank solution) | |
| ethylenediaminetetraacetic acid ferric ammonium dihydrate | 60 g |
| ethylenediaminetetraacetic acid | 3 g |
| ammonium thiosulfate (70% solution) | 100 ml |
| ammonium sulfite (40% solution) | 27.5 ml |
| add water to make 1 liter | |
| adjust pH at 7.1 by potassium carbonate or glacial acetic acid | |
| (stabilizing solution) | |
| 1,2-benzoisothiazoline-3-one | 1.0 g |
| ethylene glycol | 10 g |

The stabilization process was done in a three-tank cascade system. For comparison washing was also made according to CPK-18 standard treatment (by Konishiroku Photo Industry Co., Ltd.).

Then, the developed papers were kept at 80% RH and 70° C. for three weeks. The transmission density in the maximum density area of each of the papers was measured by the Sakura photoelectric densitometer PDA-65 (mfd. by Konishiroku Photo Ind., Co, Ltd.) and reducing rate of cyan dye density after storage was obtained in terms of percentage. The results were shown in Table 1.

Comparative coupler (1)

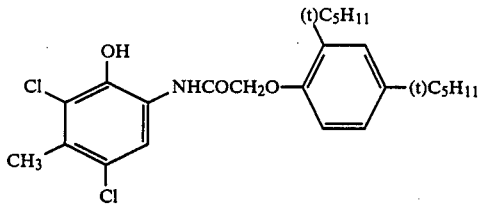

Comparative coupler (2)

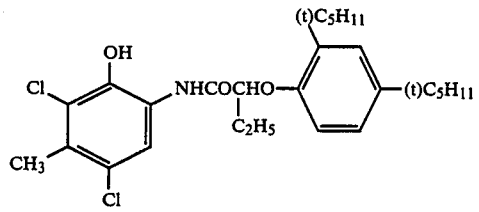

Comparative coupler (3)

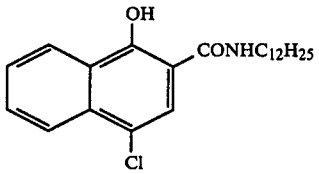

TABLE 1

| Sample No. | Cyan coupler | Process after fixing | Dye density lowering rate (%) after storage at 70° C., 80% RH |
|---|---|---|---|
| 1 Comparison | Comparative coupler (1) | CPK-18 standard treatment (w/washing) | 30 |
| 2 Comparison | Comparative coupler (2) | CPK-18 standard treatment (w/washing) | 27 |
| 3 Comparison | Comparative coupler (3) | CPK-18 standard treatment (w/washing) | 29 |
| 4 Comparison | Exemplified coupler No. (4) | CPK-18 standard treatment (w/washing) | 28 |
| 5 Comparison | Exemplified coupler No. (13) | CPK-18 standard treatment (w/washing) | 26 |
| 6 Comparison | Exemplified coupler No. (18) | CPK-18-standard treatment (w/washing) | 27 |
| 7 Comparison | Comparative coupler (1) | Stabilizing process (no washing) | 36 |
| 8 Comparison | Comparative coupler (2) | Stabilizing process (no washing) | 32 |
| 9 Comparison | Comparative coupler (3) | Stabilizing process (no washing) | 35 |
| 10 Invention | Exemplified coupler No. (4) | Stabilizing process (no washing) | 20 |

TABLE 1-continued

| Sample No. | Cyan coupler | Process after fixing | Dye density lowering rate (%) after storage at 70° C., 80% RH |
|---|---|---|---|
| 11 Invention | Exemplified coupler No. (13) | Stabilizing process (no washing) | 19 |
| 12 Invention | Exemplified coupler No. (18) | Stabilizing process (no washing) | 21 |

As is apparent from Table 1, in the Samples No. 1 to 9 prepared by combining a coupler and a washing process which were not of the invention, each of their cyan dye density after storage was apparently lowered compared with those of the Samples No. 10 to 12 each prepared by combining a cyan dye image forming coupler and a stabilizing process of the invention. Accordingly, the effect of the invention is particularly remarkable in the case of combining the cyan dye image forming coupler and the stabilization process of the invention.

Example 2

Onto a polyethylene-coated paper was coated a red-sensitive silver halide emulsion layer, a green-sensitive silver halide emulsion layer and a blue-sensitive silver halide emulsion layer in the aggregate silver amount of 10 mg per 100 $cm^2$. The emulsions were prepared by using globular grains of silver chlorobromide and the average grain size of which was 0.8 $\mu$m. In the blue-sensitive emulsion layer was used yellow-coupler (Y-1) shown below, in the green-sensitive emulsion layer was used magenta-coupler (M-1) shown below and further in the red-sensitive emulsion layer was used as a cyan coupler exemplified coupler No. (4) of the invention. Further, into each layer were added ordinary additives such as high-boiling point solvents, sensitizing dyes, hardeners and spreading agents. Thus prepared paper was called the photographic material (1) of the invention.

Next, the photographic material (2) was prepared in the same manner as in the photographic material (1) except that the comparative coupler (4) was used instead of the cyan coupler used in the photographic material (1).

(Yellow coupler Y-1)

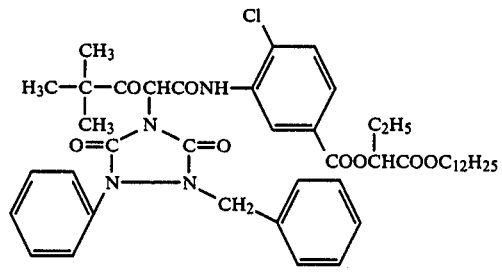

(Magenta coupler M-1)

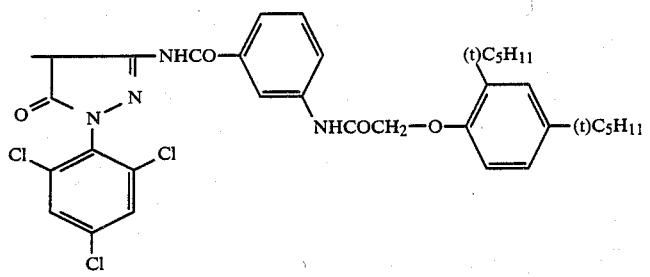

Comparative coupler (4)

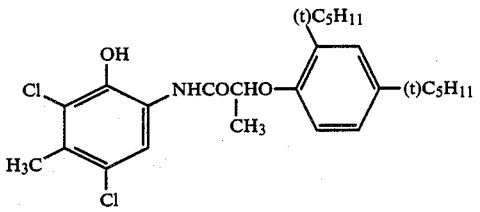

Thus prepared photographic materials (1) and (2) were exposed in an usual manner and according to the treatment steps of Example 1, were subjected to the processing based on the CPK-18 standard treatment for three consecutive weeks at the rate of 50 $m^2$ per day. As for a comparison with the process of fixing treatment, the washing method caused on CPK-18 standard treatment was adapted as in Example 1. After treatment the same evaluation was made as in Example 1.

Further, into the stabilizing solution described above were added chlating agents shown in Table-2 and the same evaluation was made as in Example 1.

TABLE 2

| Sample No. | Photographic material No. | process after bleach-fix treatment | Chelating agent (g/l) | Cyan dye lowering rate (%) after storage (%) |
|---|---|---|---|---|
| 13 Comparison | (2) | washing | nil | 20 |
| 14 Comparison | " | stabilizing process | " | 26 |
| 15 Comparison | (1) | washing | " | 19 |
| 16 Invention | " | stabilizing process | " | 15 |
| 17 Invention | " | stabilizing process | diethylenetriaminepentaacetic acid (DTPA) 3.0 g | 13 |
| 18 Invention | " | stabilizing process | 1-hydroxyethylidene-1,1-diphosphonic acid (AC-5) 1.0 g | 12 |
| 19 Invention | " | stablizing process | glucine 3.0 g | 15 |

As is apparent from Table 2, in the multi-layered samples prepared by combining the photographic material containing the coupler of the invention and the stabilizing process, cyan dye image density after storage was less reduced than those of comparative samples No. 13 to 15.

In the Samples Nos. 17 and 18 of the invention which were prepared by adding ferric ions, DTPA having chelating stability constant of not less than 6 and AC-5 to Sample No. 16 of the invention, the effect of the invention was remarkable, however, when glycine having a constant of not more than 6 constant was used, little effect was observed.

Example 3

Comparative Test

On a paper support laminated with polyethylene, the following various layers are applied successively from the support side to prepare silver halide photosensitive material.

Layer 1

A blue-sensitive silver halide emulsion layer containing 1.5 g/$m^2$ of gelatin, a blue-sensitive silver halide gelatin emulsion having 0.40 g/$m^2$ silver (based on silver), the silver halide being in a monodispersed emulsion containing 70 mol % silver chloride bromide (calculated as AgBr) and an average particle size of 0.7 $\mu$m, and containing 1.0 g/$m^2$ yellow coupler (Y-1) dissolved in 0.50 g/$m^2$ dioctyl phthalate.

Layer 2

An intermediate layer consisting of 0.70 g/$m^2$ of gelatin.

Layer 3

A green-sensitive silver halide emulsion layer containing 1.30 g/$m^2$ of gelatin, a green-sensitive silver halide gelatin emulsion having 0.40 g/$m^2$ silver which is a monodispersed emulsion containing 60 mol % silver chloride bromide (calculated as AgBr) and having average particle size of 0.6 $\mu$m, and containing 0.70 g/$m^2$ Magenta coupler (M-1) dissolved in 0.30 g/$m^2$ dioctyl phthalate.

Layer 4

An intermediate layer consisting of 1.2 g/$m^2$ of gelatin.

Layer 5

A red-sensitive silver halide emulsion layer containing 11.4 g/$m^2$ of gelatin, a red-sensitive silver halide gelatin emulsion having 0.35 g/$m^2$ silver which is a monodispersed emulsion containing 60 mol % silver chloride bromide (calculated as AgBr) and average particle size of 0.55 $\mu$m, and containing 0.50 g/$m^2$ cyanogen coupler (described in Table (3)) dissolved in 0.20 g/$m^2$ dioctyl phthalate.

Layer 6

A protective layer containing 0.50 g/$m^2$ of gelatin.

The respective silver halides of a blue-sensitive halide, a green-sensitive silver halide are sensitized by general sensitization.

(Y-1)

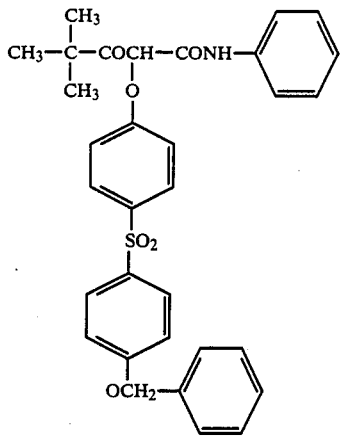

(M-1)

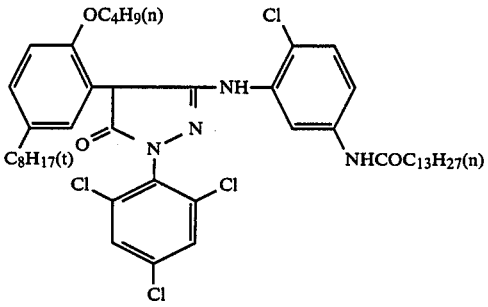

As a hardening agent, 2,4 dichloro-6-hydroxy-S-, triazine sodium is added to layers 2, 4 and 6.

Photosensitive couplers Nos. 20–29 are exposed through an optical wedge and subjected to the treatment described in Table (3).

The coupling supplementary liquid, bleaching liquid, stabilizing liquid and supplementary liquid are prepared as follows:

Coupling Supplementary Liquid

| | |
|---|---|
| Benzyl alcohol | 20 ml |
| Ethylene glycol | 20 ml |
| Potassium sulfite | 3.0 |
| Potassium carbonate | 30 g |
| Hydroxyl amine sulfate | 4.0 g |
| Polyphosphoric acid | 3.0 g |
| 3-Methyl-4-amino-N—ethyl-N—(β-methanesulfonic amide ethyl)-aniline sulfate | 7.0 g |
| Fluorescent sensitization agent (4,4-diamino stilbenedisulfone derivative) | 1.5 g |
| Potassium hydroxide | 3.0 g |
| Water is supplied to make up 1 liter. | |

Bleaching and Fixing Supplementing Liquids

| | |
|---|---|
| Ethylene diamine tetraacetic acid ferric ammonium dihydrate | 130 g |
| Potassium carbonate | 20 g |
| Ammonium thio sulfate (70% liquid) | 250 g |
| Ammonium sulfite (40% liquid) | 125 g |
| Ethylene diamine tetraacetic acid | 8 g |
| Glacial acetic acid | 42 ml |

When the supplementary amount is in a ratio of 0.1–30, preferably 0.5–10, times the amount carried over from the previous bath per unit area of the photosensitive material, a particularly desirable arrangement is achieved. Preferably, when there is one stabilizing bath, the ratio is 3–30 times, when there are 2 baths, the ratio treatment is 0.3–20 times, when there are 3 baths, the ratio is 0.3–20 times, when there are 4 baths, the ratio is 0.1–5 times. However, when there are at least 5 baths, it is undersirable from the point of view of stability of the pigment. In that case, it is necessary to treat the color photosensitive material at a ratio of at least 7.

If the supplementary stabilizing liquid is added in a ratio less than 0.1, concentration due to vaporization becomes a problem, and precipitation and the like occur. When the supplementary ratio exceeds 30, at high temperature and high humidity, discoloration of the pigment due to the coupler of the present invention becomes large, which is undesirable economically and from the viewpoint of environmental pollution.

Water is added to make the amount 1 liter and pH of this solution adjusted to 6.4.

Stabilizing Liquid and Supplementary Liquids

| | |
|---|---|
| 5-Chloro-2-methyl-4-isothiazoline-3-one | 0.02 g |
| 2-Methyl-4-isothazoline-3-one | 0.02 g |
| Ethylene glycol | 1.0 g |
| 2-Octyl-4-isothiazoline-3-one | 0.01 g |
| 1-Hydroxy ethylidene-1,1-diphosphonic acid (60% aqueous solution) | 3.0 g |
| $BiCl_3$ (45% aqueous solution) | 0.65 g |
| Ammonium thiosulfate | 10.0 g |

Water is added to make the total amount 1 liter and the pH is adjusted to 8.2 by KOH and $H_2SO_4$.

An automatic developing machine is filled with the coupling tank liquid, bleaching/fixing tank liquid and the stabilizing liquid and, while color paper is treated, the three liquids are supplemented every 3 minutes through quantitative cups. Running tests are carried out. The supplementary amount is 150 ml to the coupling tank and 50 ml of bleaching/fixing liquid to the bleaching/fixing liquid tank respectively per 1 $m^2$ of color paper. The supplementary amount of stabilizing liquid is as shown in Table 3.

The stabilizing treatment constitutes three stabilizing treating bath tubs which are improved so as to be able to operate continuously. Stabilization is carried out in the first through the third tubs in the flowing direction of photosensitive material; supplementing is carried out from the last bath and the overflow from the last tub is made to flow into the previous bath. Further, this overflow liquid is made to flow in a previous bath tub.

The stabilizing treatment time is 2 minutes and continuous treatment is carried out until the total amount of the bleaching fixing supplementary liquid used becomes equal to the bleaching/fixing tank capacity. The amount of bleaching fixing liquid introduced is 50 ml per 1 $m^2$ of the color paper.

The supplementary amount of the stabilizing liquid is varied from 8 l/$m^2$, 1.5 l/$m^2$, 250 ml/$m^2$, 50 ml/$m^2$ and 5 ml/$m^2$. After the tests are over, the couplers mentioned in Table 3 are changed and resultant paper is treated. After the treatment, the red color concentration (concentration of cyanogen pigment) is measured; thereafter the same evaluation as in Example (1) is carried out.

TABLE 3

| Sample No. | Supplementary amount (ml) | coupler | | 70° C./80% RH Decrease of concentration after storing | |
|---|---|---|---|---|---|
| Comparative 20 | 8000 (approximate condition to washing with water) | Comparative coupler (1) | 21 | | |
| Comparative 21 | | Comparative coupler (2) | 19 | | |
| Comparative 22 | | Exemplified coupler (4) | 18 | | |
| Comparative 23 | | Exemplified coupler (7) | 20 | | |
| Comparative 24 | 1500 | Comparative coupler (1) | 24 | | |
| Comparative 25 | | Comparative coupler (2) | 21 | | |
| This invention 26 | | Exemplified coupler (4) | 13 | | c.c.* (1) 25 |
| This invention 27 | | Exemplified coupler (7) | 15 | 500/m$^2$ | c.c.* (2) 22 |
| Comparative 28 | 250 | Comparative coupler (1) | 25 | | Ex. coup.* (4) 11 |
| Comparative 29 | | Comparative coupler (2) | 23 | | Ex. coup.* (7) 12 |
| This invention 30 | | Exemplified coupler (4) | 11 | | |
| This invention 31 | | Exemplified coupler (7) | 12 | | |
| Comparative 32 | 50 | Comparative coupler (1) | 28 | | |
| Comparative 33 | | Comparative coupler (2) | 27 | | |
| This invention 34 | | Exemplified coupler (4) | 11 | | c.c.* (1) 31 |
| This invention 35 | | Exemplified coupler (7) | 13 | 25/m$^2$ | c.c.* (2) 30 |
| Comparative 36 | 5 | Comparative coupler (1) | 34 | | Ex. coup.* (4) 12 |
| Comparative 37 | | Comparative coupler (2) | 32 | | Ex. coup.* (7) 14 |
| This invention 38 | | Exemplified coupler (4) | 14 | | |
| This invention 39 | | Exemplified coupler (7) | 16 | | |

note:
c.c.* Comparative coupler
Ex. coup.* Exemplified coupler

As will be clear from the results shown in Table (3), in the case of couplers other than those of the present invention, regardless of supplementary amount of stabilizing liquid, decrease in concentration of cyanogen pigment is large at high temperature and high humidity. However, in the case of the couplers of the present invention, (except when treated in the proximate condition of water washing wherein decrease of concentration of cyanogen pigment becomes large within the range of 5 ml–1500 ml/m$^2$), a drastic improvement is seen, especially in the range of 25 ml–500 ml/m$^2$.

What we claim is:

1. A method of processing a silver halide color photographic material comprising color developing said silver halide color photographic material containing a cyan coupler represented by the following Formula, then, treating said material with a processing solution having a fixing capability, and then subjecting said material to stabilizing treatment Formula

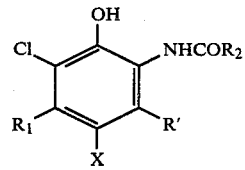

wherein R' represents hydrogen, $R_1$ represents a straight or branched alkyl group having two to four carbon atoms, X represents hydrogen or a group capable of splitting off with a coupling reaction, and $R_2$ represents a ballast group.

2. The method of processing a silver halide color photographic material as claimed in claim 1, wherein a stabilizing solution used in said stabilizing treatment step contains a chelating agent of not less than six in the constant of chelating stability to iron.

3. The method of processing a silver halide photographic material as claimed in claim 1, wherein said processing solution having the fixing capability is a bleaching-fixing solution.

4. The method of processing a silver halide photographic material as claimed in claim 1 wherein said stabilizing treatment step comprises a multistage tank system and wherein said stabilizing solution is replenished in a ratio of 0.1 to 30 times the amount of said stabilizing solution carried over from previous bath percent are of said material.

5. The method of processing a silver halide photographic material as claimed in claim 4, wherein said processing solution having a fixing capability is supplied to the rearmost tank in said stabilizing treatment step comprising a multistage tank system, and to the preceeding tank from the tank next to said rearmost tank.

6. The method of processing a silver halide photographic material as claimed in claim 1, wherein X denoted in the Formula represents hydrogen.

7. The method of processing a silver halide photographic material as claimed in claim 1, wherein X denoted in the Formula represents a halogen.

8. The method of claim 4 wherein said ratio is 0.5 to 10.

9. The method of claim 1 wherein a stabilizing solution used in said stabilizing treatment step contains an antimold agent.

10. The method of claim 8 wherein said antimold agent is selected from isothiazoline, benzimidazole, benzoisothiazline, thiabendazole, phenol, mercapto, organic halogen-substituted compounds, benzoic acid and the derivatives thereof.

11. The method of claim 9 wherein said antimold agent is selected from isothiazoline, benzoisothiazoline, thiabendazole, phenol and benzoic acid.

12. The method of claim 10 wherein said antimold agent is selected from isothiazoline, benzoisothiazline and thiabendazole.

* * * * *